US011559749B2

(12) United States Patent
Raij et al.

(10) Patent No.: US 11,559,749 B2
(45) Date of Patent: Jan. 24, 2023

(54) SYSTEMS AND METHODS FOR THRUST-VECTORED PRACTICAL FLUID FLOW EFFECTS

(71) Applicant: Universal City Studios LLC, Universal City, CA (US)

(72) Inventors: Andrew Raij, Orlando, FL (US); Geovanny Treminio, Orlando, FL (US); Justin Hare, Orlando, FL (US); David Gerard Majdali, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 20 days.

(21) Appl. No.: 17/364,152

(22) Filed: Jun. 30, 2021

(65) Prior Publication Data

US 2022/0054949 A1 Feb. 24, 2022

Related U.S. Application Data

(60) Provisional application No. 63/067,125, filed on Aug. 18, 2020.

(51) Int. Cl.

| | |
|---|---|
| ***A63G 31/16*** | (2006.01) |
| ***B05B 12/12*** | (2006.01) |
| *A63G 7/00* | (2006.01) |
| *A63J 5/00* | (2006.01) |
| *A63J 5/02* | (2006.01) |

(52) U.S. Cl.

CPC ..... *A63G 31/16* (2013.01); *B05B 12/122* (2013.01); *A63J 5/025* (2013.01); *A63J 2005/006* (2013.01)

(58) Field of Classification Search

CPC ..... A63G 7/00; A63G 31/00; A63G 31/16; B05B 12/122

USPC ..... 472/43, 59, 60, 128, 130

See application file for complete search history.

(56) References Cited

U.S. PATENT DOCUMENTS

| | | | |
|---|---|---|---|
| 6,179,619 | B1 | 1/2001 | Tanaka |
| 10,323,854 | B2 | 6/2019 | Byers |
| 2006/0135271 | A1 | 6/2006 | Casey et al. |

(Continued)

OTHER PUBLICATIONS

PCT/US2021/045180 International Search Report and Written Opinion dated Dec. 3, 2021.

*Primary Examiner* — Kien T Nguyen

(74) *Attorney, Agent, or Firm* — Fletcher Yoder, P.C.

(57) ABSTRACT

An amusement park attraction effects system includes a dynamic display for viewing by a user traveling through an attraction, a display monitor to provide status data indicative of a status of the dynamic display, a location identification system to determine a location of the user, a thrust-vectoring flow effect generator to generate and direct a fluid flow toward any particular target location of a range of target locations, and an automation controller communicatively coupled to the display monitor, the location identification system, and the thrust-vectoring flow effect generator. The automation controller is configured to receive the status data, receive the location of the user, set a target location based on the location of the user, instruct the thrust-vectoring flow effect generator to direct the fluid flow based on the target location, and instruct the thrust-vectoring flow effect generator to control the fluid flow based on the status data.

20 Claims, 4 Drawing Sheets

(56) References Cited

U.S. PATENT DOCUMENTS

| | | | | |
|---|---|---|---|---|
| 2016/0136527 | A1* | 5/2016 | Hunter | A63G 3/02<br>472/88 |
| 2016/0363341 | A1 | 12/2016 | Arens et al. | |
| 2017/0130978 | A1 | 5/2017 | Edwards et al. | |
| 2019/0004598 | A1 | 1/2019 | Gordt et al. | |
| 2019/0118760 | A1 | 4/2019 | Hall et al. | |
| 2020/0098190 | A1 | 3/2020 | Goergen et al. | |

* cited by examiner

SYSTEMS AND METHODS FOR THRUST-VECTORED PRACTICAL FLUID FLOW EFFECTS

CROSS-REFERENCE TO RELATED APPLICATIONS

This application claims priority from and the benefit of U.S. Provisional Application Ser. No. 63/067,125, entitled "SYSTEMS AND METHODS FOR THRUST-VECTORED PRACTICAL FLUID FLOW EFFECTS," filed Aug. 18, 2020, which is hereby incorporated by reference in its entirety for all purposes.

BACKGROUND

The present disclosure relates generally to fluid flow effects for amusement park attractions and experiences.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks often contain attractions or experiences that use fluid flow (e.g., air, smoke, mist, fog, steam, fire, water spray) effects to provide enjoyment and entertain guests of the amusement parks. For example, the attractions may include themed environments established using display devices displaying media content (e.g., in the form of video, text, still image, motion graphics, or a combination thereof). For some attractions, it may be desirable to accompany media content with fluid flow effects to create a realistic and/or immersive viewing or playing experience for an audience. In one example, such fluid flow effects may be achieved using large fans providing a wide area of effect for an entire audience. However, providing air effects to guests may be challenging due to considerations relating to spacing of guests, individualizing guest experiences, cost, space, equipment availabilities, and/or noise, for example.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In one embodiment, an amusement park attraction effects system includes a dynamic display configured for viewing by a user traveling through an attraction. The amusement park attraction effects system also includes a display monitor configured to monitor changes to the dynamic display and provide status data indicative of a status of the dynamic display and a location identification system configured to determine a location of the user. The amusement park attraction effects system also includes a thrust-vectoring flow effect generator configured to generate and direct a fluid flow toward any particular target location of a range of target locations within the attraction and an automation controller communicatively coupled to the display monitor, the location identification system, and the thrust-vectoring flow effect generator. The automation controller is configured to receive the status data provided by the display monitor and receive the location of the user provided by the location identification system. The automation controller is also configured to set a target location based on the location of the user, wherein the target location is within the range of target locations. The automation controller is also configured to instruct the thrust-vectoring flow effect generator to direct the fluid flow based on the target location and instruct the thrust-vectoring flow effect generator to control the fluid flow based on the status data.

In another embodiment, an amusement park attraction effects system includes a dynamic display configured for viewing by a plurality of users, a display monitor configured to monitor changes to the dynamic display and provide status data indicative of a status of the dynamic display, and a location identification system configured to determine a plurality of locations of the plurality of users. In an embodiment, the amusement park attraction effects system also includes an array of thrust-vectoring flow effect generators including a first thrust-vectoring flow effect generator and a second-thrust vectoring flow effect generator. In an embodiment, the first thrust-vectoring flow effect generator is configured to generate and direct a first fluid flow toward a first target location of a range of target locations and the second thrust-vectoring flow effect generator is configured to generate and direct a second fluid flow toward a second target location of the range of target locations. In an embodiment, the amusement park attraction effects system also includes an automation controller communicatively coupled to the display monitor, the location identification system, and the array. The automation controller is configured to receive the status data provided by the display monitor, receive the plurality of locations of the plurality of users provided by the location identification system, and set the first target location and the second target location based on the plurality of locations of the plurality of users. The automation controller is also configured to instruct the first thrust-vectoring flow effect generator to direct the first fluid flow based on the first target location and instruct the second thrust-vectoring flow effect generator to direct the second fluid flow based on the second target location.

In another embodiment, an amusement park attraction effects system includes a head-mounted virtual reality (VR) device comprising an electronic display configured to display an image to a user of the head-mounted VR device. The amusement park attraction effects system also includes a user sensing system of the head-mounted VR device, the user sensing system configured to detect a location and orientation of the user and output data indicative of the location and orientation. The amusement park attraction effects system also includes a directed airflow generator configured to generate an air effect and direct the air effect to a target location and an automation controller communicatively coupled to the user sensing system and the directed airflow generator. The automation controller is configured to receive the data output by the user sensing system and determine, based on the location and the orientation indicated by the data, the target location for directing the air effect. The automation controller is also configured to control the directed airflow generator to direct the air effect towards the target location.

Various refinements of the features noted above may be undertaken in relation to various aspects of the present disclosure. Further features may also be incorporated in these various aspects as well. These refinements and additional features may exist individually or in any combination.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Further, to the extent that certain terms such as parallel, perpendicular, and so forth are used herein, it should be understood that these terms allow for certain deviations from a strict mathematical definition, for example, to allow for deviations associated with manufacturing imperfections and associated tolerances.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to fluid flow effects, and, more particularly, to thrust-vectored fluid flow effects systems for amusement park attractions and experiences. The attractions may include any type of ride system that is designed to entertain a passenger, such as an attraction that includes a ride vehicle that travels along a path, an attraction that includes a room or theatre with stationary or moving seats for passengers to sit in while the passengers watch a video, an attraction that includes a pathway for guests to travel along, a room for guests to explore, or the like. In particular, the thrust-vectored fluid flow effects system provides individualized fluid flow effects to guests, but without the challenges and/or costs associated with providing such fluid flow effects over large areas and/or significant numbers of guests. Additionally, while the disclosed embodiments generally discuss fluid flow effects that are used for entertainment purposes, the disclosed embodiments may also apply to fluid flow effects systems that are used for any other suitable purpose.

Figure 1:
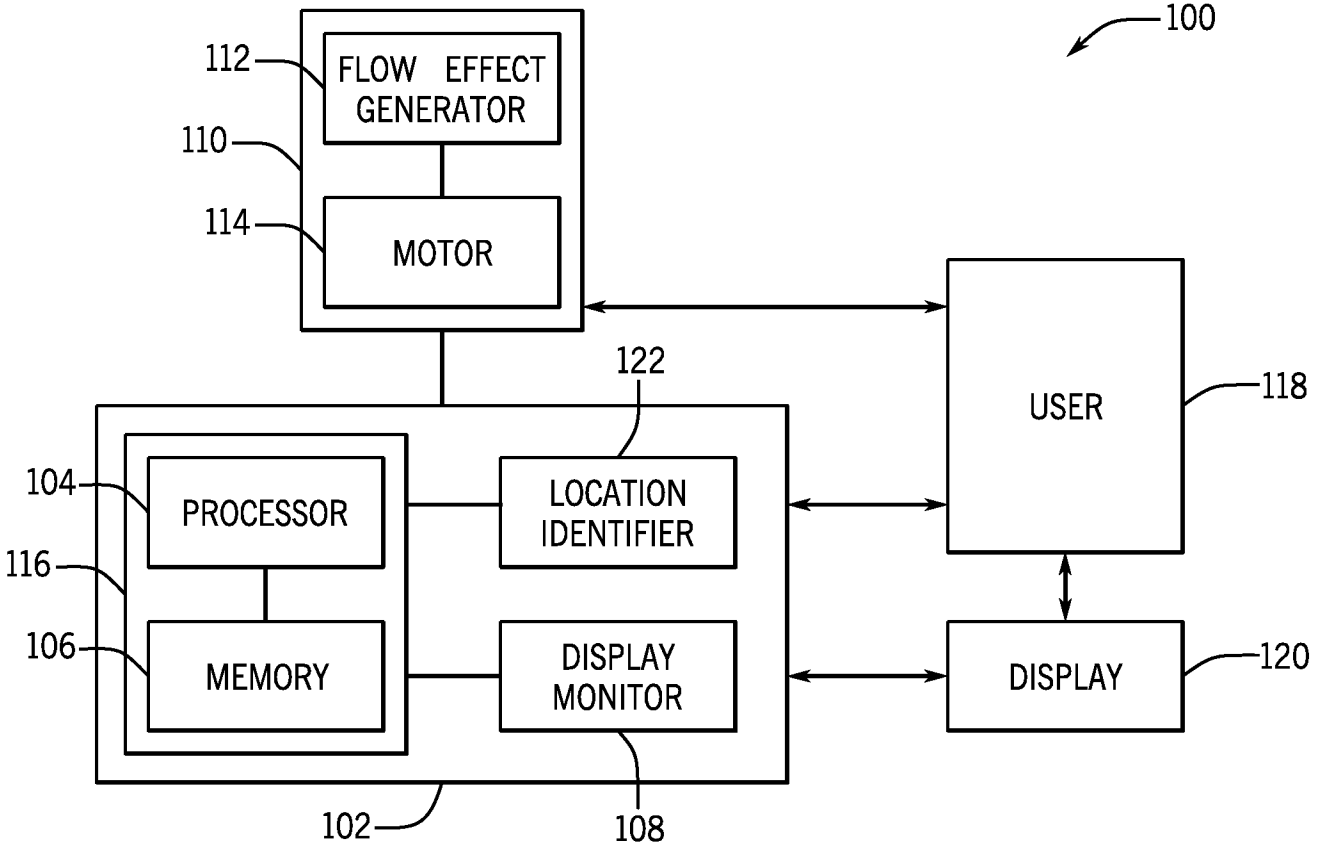
FIG. 1 is a schematic block diagram of an amusement park attraction effects system, in accordance with an embodiment of the present disclosure.

With the foregoing in mind, FIG. 1 illustrates an amusement park attraction effects system, such as the fluid flow effects system 100 including a system controller block 102, a flow effect component 110, and a dynamic display 120, according to an embodiment of the present disclosure. The fluid flow effects system 100 may be used to provide fluid flow effects to one or more users 118 during an amusement park attraction and/or experience. In certain embodiments, the system controller block 102, the flow effect component 110, and/or the display 120 may be incorporated on a ride vehicle of the amusement park attraction and/or experience. The system controller block 102 may control operation of the flow effect component 110 and may process data acquired by a display monitor 108 and a location identifier 122. The flow effect component 110 may be coupled to the system controller block 102 by any suitable techniques for communicating data and control signals between the flow effect component 110 and the system controller block 102, such as a wireless, optical, coaxial, or other suitable connection.

The flow effect component 110 may include a thrust-vectored flow effect generator 112 and a motor 114. The thrust-vectored flow effect generator 112 may include a nozzle configured to symmetrically or asymmetrically expand and constrict and is capable of thrust vectoring (e.g., thrust vector control), which herein means the thrust-vectored flow effect generator 112 operates to manipulate direction, speed, area of effect, and angular aspects of fluid flow streams therethrough. The thrust-vectored flow effect generator 112 may generate a fluid flow effect (e.g., air, smoke, mist, fog, steam, fire, water spray) and may direct the fluid flow effect towards one or more users 118. The thrust-vectored flow effect generator 112 may include a nozzle capable of altering an area of effect, a duration, and/or a speed, and/or a direction of the fluid flow effect. In certain embodiments, the thrust-vectored flow effect generator 112 may include a fan capable of generating a steady speed fluid flow effect and/or dynamic fluid flow effect. For example, the thrust-vectored flow effect generator 112 may be capable of generating a fluid flow effect at a range of speeds from zero to thirty kilometers per hour (e.g., zero to twenty kilometers per hour, zero to fifteen kilometers per hour, zero to ten kilometers per hour, zero to five kilometers per hour).

The flow effect component 110 may utilize pressurized air (e.g., compressed air) to generate fluid flow effects. In some embodiments, the thrust-vectored flow effect generator 112 may include an air compressor capable of generating a compressed fluid flow effect. For example, the thrust-vectored flow effect generator 112 may generate a burst (e.g., less than five seconds, less than two seconds, less than one second) of compressed air as a fluid flow effect. The flow effect component 110 may utilize pressurized air to generate haptic effects. As used herein, haptic effects refer to creating an experience or sense of touch to the user 118. For example, the flow effect component 110 may provide tactile feedback to the user 118 by generating bursts of compressed air. The thrust-vectored flow effect generator 112 may include a nozzle with any number of outlets capable of generating different flow effects (e.g., patterns, intensities, sensations). For example, the user 118 may feel a sensation of being poked and/or a sensation of a projectile passing nearby and/or hitting the user 118 due to a single pressurized air burst corresponding to a single outlet of the nozzle. As another example, the user 118 may experience a tingling sensation as a result of any number of pinpoint pressurized air bursts corresponding to any number of outlets on the nozzle. In certain embodiments, the flow effect component 110 may include an array containing any number of thrust-vectored flow effect generators 112. For example, the array may include one or more thrust-vectored flow effect generators 112 associated with each user 118. The thrust-vectored flow effect generator 112 may be capable of altering a temperature of the fluid flow effect. For example, the thrust-vectored flow effect generator may include a heating and/or cooling component capable of increasing and/or decreasing the temperature of the fluid flow effect relative to an ambient temperature. Additionally or alternatively, the thrust-vectored flow effect generator 112 may include a water component capable of increasing a water content of the fluid flow effect. For example, the water component may provide water to the fluid flow effect to generate a mist or water spray directed towards a user 118.

The system controller block 102 may control operation of the motor 114. In some embodiments, the motor 114 may be capable of adjusting the thrust-vectored flow effect generator 112 according to signals received from the system controller block 102. For example, the motor 114 may be capable of adjusting a configuration of a nozzle of the thrust-vectored flow effect generator 112 to alter an area of effect, a duration, and/or a speed, and/or a direction of the fluid flow effect. In certain embodiments, each thrust-vectored flow effect generator 112 may include a corresponding motor 114.

The dynamic display 120 may be capable of depicting one or more images (e.g., still image, video image) to be viewed by one or more users 118. The display 120 may depict images associated with fluid flow effects. For example, an image depicting a windy day may be associated with strong, steady gust of air, an image depicting an explosion may be associated with a hot, burst of air, an image depicting travelling in a boat may be associated with a light mist, and so forth. In some embodiments, the display 120 may be an electronic display, such as an LED screen, LCD screen, plasma screen, projector, or any other suitable electronic display. In certain embodiments, the display 120 may be a head-mounted display (HIVID). For example, the display 120 may be a display device worn on the head of a user 118 and the display 120 may be placed in front of either one or both eyes of the user 118. The display 120 may display computer-generated imagery, live imagery, virtual reality imagery, augmented reality imagery, mixed reality imagery, and so on. Additionally or alternatively, the display 120 may be located on a surface, such as a wall, ceiling, and/or floor of an amusement park attraction or experience. For example, the display 120 may include a projector capable of projecting images onto a display screen. In some embodiments, the display 120 may be viewed by any number of users 118. Additionally or alternatively, the display 120 may be a stage for viewing by any number of users 118. For example, the stage may include any number of props, such as animatronic figures, performers, stationary objects, electronic displays, and so forth. The display 120 may include a performance on the stage including any number of props. In certain embodiments, the user 118 may control images depicted by the display 120 based on a selection by the user. For example, the user 118 may be able to select a viewing experience depicted on the display according to the user's preference.

As will be appreciated, the system controller block 102 may include a number of elements to control operation of the flow effect component 110, facilitate and/or monitor display of images on the display 120, and identify and/or track locations of one or more users 118. For instance, as illustrated, the system controller block 102 may include a display monitor 108, a location identifier 122, and an automation controller 116. In certain embodiments, the system controller block 102 may include additional elements not shown in FIG. 1, such as additional data acquisition and processing controls, additional sensors and display monitors, user interfaces, and so forth.

The display monitor 108 may monitor changes to the display 120 and may generate status data associated with a status of the display 120. In certain embodiments, the display monitor 108 may be communicatively coupled to the display 120, such as a wireless, optical, coaxial, or other suitable connection. For example, the display monitor 108 may be configured to receive a signal from the display 120. The signal may be associated with a status of the display 120. For example, the status may indicate the display 120 is beginning a user experience for any number of users 118, may indicate the display 120 is ending a user experience for any number of users 118, may indicate the display 120 is changing according to a selection by a user 118, and the status may indicate the display 120 is depicting an image associated with a fluid flow effect. Additionally or alternatively, the display monitor 108 may control movement of props on a stage and/or may control an electronic display, separate from the display 120, to depict images. In some embodiments, the display monitor 108 may be a camera capable of monitoring the display 120, such as detecting movement of props on a stage. Additionally or alternatively, the display monitor 108 may monitor changes to an electronic display, such as movement of objects depicted in the electronic display. In certain embodiments, the display monitor 108 may monitor data signals and/or instructions sent to the electronic display in order to determine changes in to the electronic display. In such embodiments, the display monitor 108 may be integral with the display 120. The display monitor 108 may be communicatively coupled to the system controller block 102, such as a wireless, optical, coaxial, or other suitable connection. The display monitor 108 may generate a signal corresponding to a status of the display 120 and may send the signal to the system controller block 102 for processing.

In some embodiments, the display monitor 108 may be a sensor such as a light sensor and may detect light emitted from the display 120. For example, the sensor may detect visible light, infrared light, ultraviolet light, and/or light in any other suitable portion of the electromagnetic spectrum. The display monitor 108 may transmit a data signal to the processor 104 in response to the detection of the light. For example, the display monitor 108 may detect a watermark presented by the display 120, wherein the watermark is not visible to a human (e.g., infrared light or undiscernible pixelation) and corresponds to a particular depiction. Further, in such an example, in response to detection of the watermark, the display monitor 108 may provide the data signal, which may indicate that the display 120 is depicting an image associated with a fluid flow effect (e.g., a movie scene with wind blowing water over a ship), beginning a display sequence associated with a fluid flow effect, ending a display sequence associated with a fluid flow effect, or any other suitable status indication associated with the display 120.

As discussed in more detail below, operation of the display 120 is coordinated with operation of the flow effect component 110 to produce a fluid flow effect corresponding to a status of the display 120, such as an image being depicted on the display 120. To facilitate coordination between the display 120 and the flow effect component 110, in an embodiment, the display 120 may emit a pulse of light (e.g., starting pulse, starting light), such as infrared light, indicative of beginning a display sequence associated with a fluid flow effect. For example, the display 120 may emit the pulse of light and the display monitor 108 may detect the pulse of light. In an embodiment, the display monitor 108 may generate and transmit a data signal to the processor 104 indicative of the detected pulse of light. Then, the processor 104 may control the flow effect component 110 based on and/or in response to receipt of the data signal. In certain embodiments, the pulse of light may be a separate light or may be a component of the display 120. Additionally or alternatively, the display 120 may indicate the beginning of a display sequence associated with a fluid flow effect by sound, a watermark, a particular image or series of images, a data signal transmitted via wireless, optical, coaxial, or any other suitable connection, or any other suitable means of communication between the display 120 and the display monitor 108.

The location identifier 122 may determine a location of one or more users 118 and may track the location of the one or more users 118. In some embodiments, the location identifier 122 may include a camera capable of detecting one or more users 118 and determining the location of the one or more users 118. For example, the camera may be an infrared camera capable of detecting one or more users 118 based on a heat signature associated with the one or more users 118. In certain embodiments, the location identifier 122 may include a processor to process location data and determine and/or identify the location of one or more users, the body orientation of one or more users, a location of a specific body part (e.g., head, neck, arm, hand, leg, and so forth) of one or more users, areas of exposed skin of one or more users, or any combination thereof. Additionally or alternatively, the location identifier 122 may include any number of pressure sensors on a floor of an amusement park attraction, a floor of a ride vehicle, and/or a seat of a ride vehicle. In some embodiments, the location identifier 122 may include any suitable device for detecting one or more users 118, determining the location of the one or more users 118, and/or tracking the location of the one or more users 118. For example, the location identifier 122 may include a sensor and a device capable of generating a signal for detection by the sensor, such as a radio frequency identification (RFID) sensor and a RFID tag, such as in a wearable device on a user 118 and/or a portable device being carried by a user 118, a Global Positioning System (GPS) device, camera-based blob trackers, skeletal trackers, optical trackers, light detection and ranging (LIDAR), and so forth. It should be noted that not only basic location information may be identified but also orientation information (e.g., in what direction a user is looking or facing).

The location identifier 122 may include any number of tracking devices. For example, the location identifier 122 may include a single device corresponding to each user 118 of the amusement park attraction. In some embodiments, the location identifier 122 may include a single device capable of determining and tracking locations of any number of users 118 of the amusement park attraction. The location identifier 122 may generate a signal corresponding to the locations of the one or more users 118 and may send the signal to the system controller block 102. The location identifier 122 may also provide orientation information, which may be based on sensors (e.g., accelerometers resident in headsets worn by the users 118).

The system controller block 102 may be provided in the form of a computing device, such as a programmable logic controller (PLC), personal computer, a laptop, a tablet, a mobile device, a server, or any other suitable computing device. The system controller block 102 may be a control system having multiple controllers, such as automation controller 116, each having at least one processor 104 and at least one memory 106. In some embodiments, the memory 106 may include one or more tangible, non-transitory, computer-readable media that store instructions executable by the processor 104 (representing one or more processors) and/or data to be processed by the processor 104. For example, the memory 106 may include random access memory (RAM), read only memory (ROM), rewritable non-volatile memory such as flash memory, hard drives, optical discs, and/or the like. Additionally, the processor 104 may include one or more general purpose microprocessors, one or more application specific processors (ASICs), one or more field programmable logic arrays (FPGAs), or any combination thereof. Further, the memory 106 may store user location data obtained via the location identifier 122, display data obtained via the display monitor 108, and/or algorithms utilized by the processor 104 to help control operation of the flow effect component 110 based on user location data and display data. The processor 104 may control generation of fluid flow effects via the thrust-vectored flow effect generator 112. Additionally, the processor 104 may process acquired data to generate control signals for the thrust-vectored flow effect generator 112 and/or the motor 114, may control and/or monitor operation of the display 120, and/or may detect and locate one or more users 118.

The processor 104 may receive user location data from the location identifier 122. The user location data may correspond to any number of locations associated with any number of users 118. In certain embodiments, the processor may process user location data to determine locations of one or more users, body orientations of one or more users, locations of specific body parts of one or more users, areas of exposed skin of one or more users, or any combination thereof. The processor 104 may process the user location data to set any number of target locations based on the determined locations, body orientations, locations of specific body parts (e.g., head, neck, arm, hand, leg, and so forth), areas of exposed skin, or any combination thereof. For example, the processor 104 may receive user location data from a skeletal tracker device of the location identifier 122 and may identify body parts based on a model of joints and body parts generated by the skeletal tracker and set a target location of a user's hand. Additionally or alternatively, the processor 104 may receive user location data from an infrared camera device of the location identifier 122 and may determine areas of exposed skin based on measured heat signatures.

The processor 104 may control operation of the flow effect component 110 based on the received location data, the determined areas of exposed skin, the determined locations of body parts, or any combination thereof. For example, the processor 104 may generate and transmit a control signal (e.g., via wired or wireless communication, via an antenna) to the flow effect component 110 to begin and/or alter a fluid flow effect associated with the status of the display 120. In an embodiment, the control signal may indicate what type of fluid flow effect to generate (e.g., air, smoke, mist, fog, steam, fire, water spray), a speed of the fluid flow effect, a temperature of the fluid flow effect, a direction of the fluid flow effect, a target (e.g., area, size of area, exposed skin, body part) of the fluid flow effect, or any combination thereof. Additionally or alternatively, the processor 104 may generate and transmit a control signal to the motor 114 to begin generation of the fluid flow effect, alter a speed (e.g., increase, decrease) of the fluid flow effect, adjust a direction of the fluid flow effect, or cease generation of a fluid flow effect. For example, the control signal may indicate a nozzle of the flow effect generator 112 may open, close, contract, or expand to alter a direction of the fluid flow effect, an area of effect of the fluid flow effect, and/or a speed of the fluid flow effect. In certain embodiments, the nozzle may include a plurality of movable vanes configured to direct the generated fluid flow effect. For example, the nozzle may deflect the fluid flow effect, alter a speed of the fluid flow effect, and/or alter an area of effect of the fluid flow effect. In certain embodiments, the nozzle may be a variable area nozzle and may adjust an exit area of the nozzle. The variable area nozzle may have a first, or symmetric, configuration having a centerline of the exit area of the nozzle aligned with a centerline of a fan generating the fluid flow effect. The flow effect generator 112 may adjust a configuration of the exit area by moving one or more vanes of the nozzle. As such, the exit area may be asymmetric (e.g., off-center) and the nozzle may direct the fluid flow effect in a new direction corresponding to the changed configuration of the exit area. Additionally or alternatively, the processor 104 may generate and transmit a control signal to the flow effect component 110 to turn off one or more flow effect generators 112 and/or one or more motors 114. In certain embodiments, the processor 104 may dynamically control operation of the flow effect component 110. For example, the processor may set and dynamically update a target location for the flow effect component 110 in response to dynamically updated user location data.

Additionally or alternatively, the processor 104 may generate and transmit control signals to both the flow effect component 110 and the display 120 to begin operation (e.g., in a coordinated manner, in a timed manner). In an embodiment, the processor 104 may generate and transmit control signals to the display 120 to begin operation (e.g., to display an image frame), such as in response to receipt of a signal (e.g., user location data) from the location identifier 122 indicating one or more users 118 are present for the amusement park experience and/or ready for the amusement park experience, in response to receipt of a signal indicative of show timing, in response to receipt of a signal that the flow effect component 110 is ready (e.g., turned on, receiving power), and/or in response to receipt of a signal from the user (e.g., via a user interface, which may be associated with the display 120 or may be within the attraction that uses the display 120) that indicates that the user is ready to observe the display 120, for example. The processor 104 may generate and transmit a control signal to the flow effect component 110 to operate one or more thrust-vectored flow effect generators 112. For example, the processor 104 may operate an array of thrust-vectored flow effect generators 112 to generate a fluid flow effect pattern, such as a desired shape (e.g., circle, square, rectangle, and so forth), a letter, a number, a word, and so on. Additionally or alternatively, the processor 104 may operate the array of thrust-vectored flow effect generators 112 to produce any number of fluid flow effect patterns similar to spray patterns for a water hose (e.g., wide pattern, shower pattern, jet pattern, fan pattern, pulsed pattern, and so forth). In certain embodiments, the processor may alter a fluid flow effect, turn on, and/or turn off any number of thrust-vectored flow effect generators 112 to form an outline of a fluid flow effect pattern and/or desired shape. Additionally or alternatively, the processor 104 may operate the array of thrust-vectored flow effect generators 112 to generate any number of fluid flow effect patterns. For example, the processor may alter a fluid flow effect and may alternate turning on and/or turning off any number of thrust-vectored flow effect generators 112 to generate a sequence of fluid flow effect patterns. In certain embodiments, the user 118 may be able to select any number of fluid flow effect patterns. For example, the user 118 may select a desired fluid flow effect pattern, a speed of the fluid flow effect, a temperature of the fluid flow effect, and/or any other suitable aspect of the fluid flow effect according to a user preference.

Figure 2:
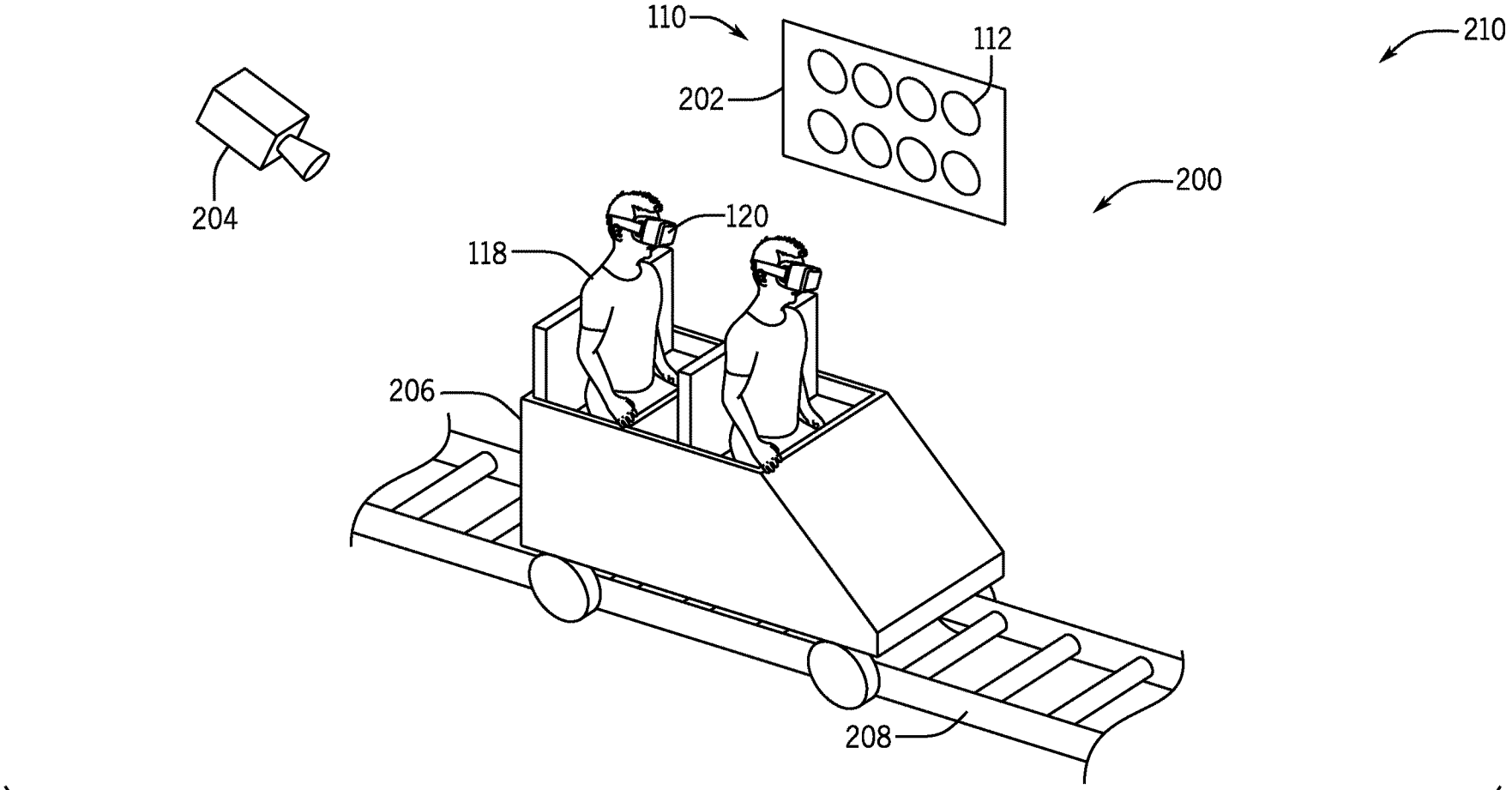
FIG. 2 is a perspective view of an amusement park attraction incorporating an amusement park attraction effects system, in accordance with an embodiment of the present disclosure.
Figure 3:
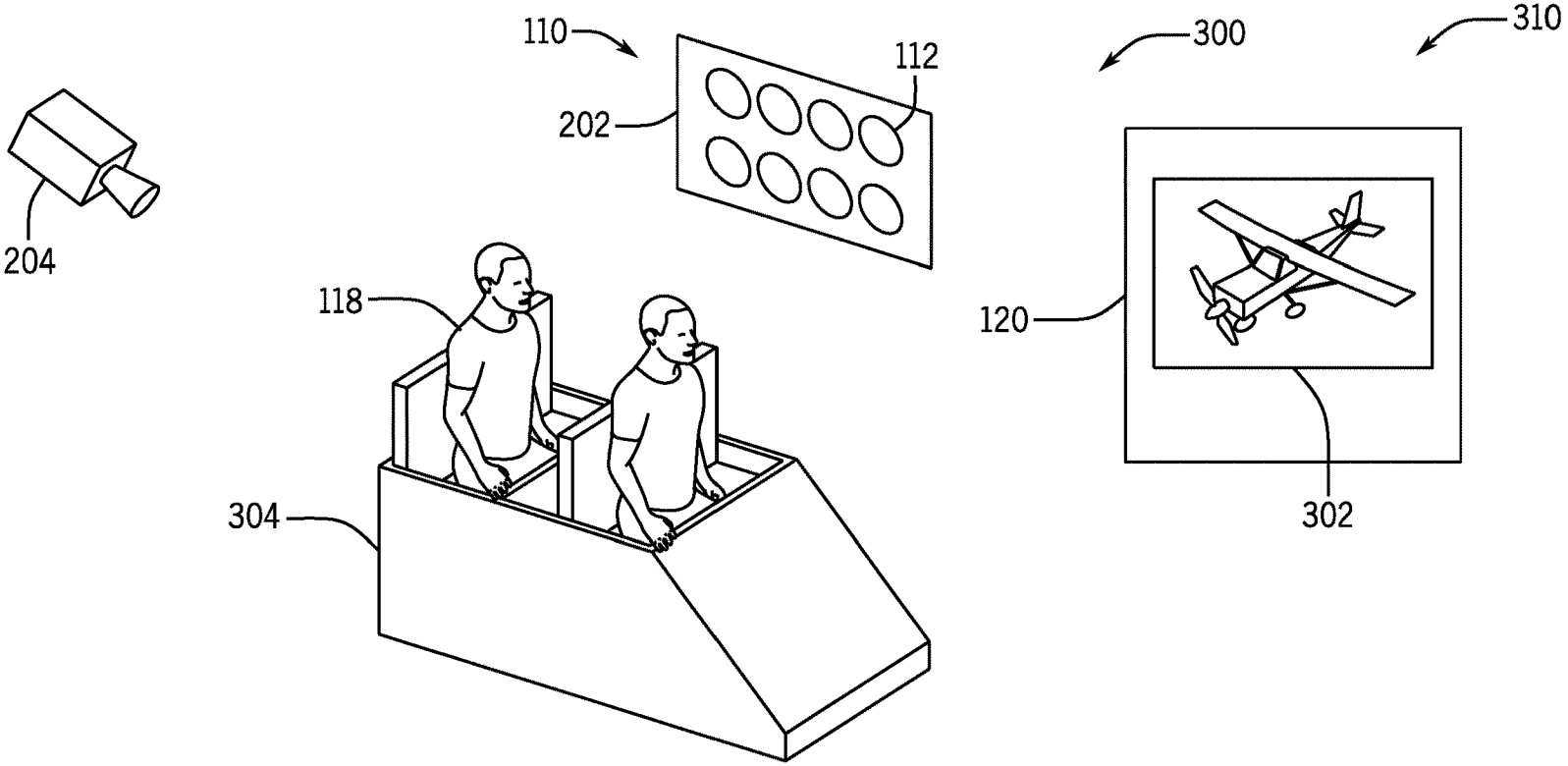
FIG. 3 is a perspective view of an amusement park attraction incorporating an amusement park attraction effects system, in accordance with an embodiment of the present disclosure.

With the foregoing in mind, FIG. 2 illustrates an amusement park attraction 210 incorporating an amusement park attraction effects system 200, such as the fluid flow effects system 100 of FIG. 1, in accordance with an embodiment of the present disclosure. The amusement park attraction effects system 200 includes a display 120. In certain embodiments, the display 120 may be a head-mounted device that may be worn by a user 118 by placing a frame of the head-mounted device about the head of the user 118 and wearing the head-mounted device in a manner that is similar to wearing a pair of glasses. In an embodiment, the head-mounted device may be a pair of glasses. In certain embodiments, the display 120 may be a mixed reality display, augmented reality display, virtual reality display, computer generated imagery display, and/or live imagery display. The amusement park attraction 210 may include a ride vehicle 206 moving along a path extending through the amusement park attraction 210, such as track 208. The ride vehicle 206 may include spacing and one or more seats for one or more users 118 to sit in the ride vehicle 206 during the duration of the amusement park attraction 210. The system 200 may include a location identifier, such as camera 204, and a flow effect component 110 including an array 202 of one or more flow effect generators 112. The camera 204 may detect the presence of one or more users in the amusement park attraction 210, such as being seated in the ride vehicle 206. For example, the camera 204 may be an infrared camera capable of detecting a heat signature associated with a user 118. In some embodiments, the camera 204 may detect and/or determine the location of specific body parts (e.g., head, neck, hand) of the user 118 and/or the location of exposed skin of the user 118. Additionally or alternatively, the ride vehicle 206 may include pressure sensors on the floor and/or the seats to detect the presence of one or more users. In certain embodiments, the camera 204 may dynamically update (e.g., periodically, in real-time) a location of the user 118 as the ride vehicle 206 moves along the track 208. The array 202 may include any number of flow effect generators 112. For example, the array 202 may include one flow effect generator 112 for each user 118 of the amusement park attraction effects system 200, multiple flow effect generators 112 for each user 118 of the amusement park attraction effects system 200, or one flow effect generator 112 for multiple users 118 of the amusement park attraction effects system 200. In some embodiments, each flow effect generator 112 may be a nozzle and may direct a corresponding air effect towards a corresponding user. For example, each flow effect generator 112 in the array 202 may be coupled to a single source of compressed air to generate a corresponding air effect. Additionally or alternatively, each flow effect generator 112 in the array 202 may be coupled to a corresponding source of compressed air to generate a corresponding air effect.

In certain embodiments, the display 120 may be a component of a computing device, such as a mobile device. Additionally or alternatively, the computing device may include the automation controller 116 of FIG. 1 and the location identifier 122. For example, the computing device may include a Global Positioning System (GPS) for determining a location of the user 118 and/or a gyroscope for determining a body orientation of the user 118. Additionally or alternatively, the camera 204 may generate and transmit user location data to the computing device. In some embodiments, the computing device may generate and transmit a signal corresponding to one or more target locations to the flow effect component 110. The computing device may instruct the flow effect component 110 to control fluid flow based on a status of the display 120. For example, the display 120 may depict an image of a fire and the computing device may instruct a heating component of the flow effect component 110 to increase the temperature of the fluid flow and/or direct the heated fluid flow towards a user 118. In certain embodiments, the computing device, such as system controller block 102 in FIG. 1, may instruct the flow effect component 110 to dynamically control the fluid flow based on the status of the display 120. For example, the display 120 may depict a user approaching a virtual fire on a side of the user. The computing device may receive dynamically updated user location data from the location identifier, such as camera 204. As a result, the computing device, such as system controller block 102 in FIG. 1, may instruct the flow effect component 110 to dynamically control the fluid based on an apparent distance between the virtual fire and the user 118. For example, as the ride vehicle 206 and user 118 move closer to the virtual fire, the system controller block 102 may instruct the flow effect component 110 to increase a temperature of the fluid flow effect. Additionally or alternatively, the system controller block 102 may dynamically control operation of the flow effect component 110 to adjust a target location of one or more flow effect generators 112. For example, as the ride vehicle 206 and user move closer to the virtual fire, the system controller block 102 may instruct the flow effect component 110 to adjust a target location of the user 118 from a front facing portion of the user 118 as the user 118 approaches the virtual fire, to a side portion of the user 118 as the user 118 passes by the virtual fire, and to a rear facing portion of the user 118 as the user moves away from the virtual fire.

Additionally or alternatively, a first flow effect generator of the array 202 may generate a different fluid flow effect from a second flow effect generator of the array 202. For example, a first user may view an image on a corresponding display 120 associated with a hot fluid effect, such as traveling nearby a volcano. A second user may view an image on a corresponding display 120 associated with a cold fluid effect, such as travelling over a frozen tundra. As such, the display monitor 108 of FIG. 1 may receive a first signal corresponding to the display associated with the hot fluid effect and may receive a second signal corresponding to the display associated with the cold fluid effect. The display monitor 108 may provide status data indicative of two or more displays to the system controller block 102. The system controller block 102 may control operation of the first flow effect generator to generate a hot fluid effect and may instruct the first flow effect generator to direct the hot fluid effect towards the first user and may control operation of the second flow effect generator to generate a cold fluid effect and may instruct the second flow effect generator to direct the second fluid effect towards the second user. As such, the amusement park attraction effects system 200 may control and operate any number of flow effect generators to generate any number of fluid flow effects, including differing fluid flow effects, and target any number of users. Additionally or alternatively, the system controller block 102 may determine the first user is located adjacent (e.g., within ten feet, within five feet, within one foot) a second user based on the location data received from the location identifier 122. As such, the system controller block 102 may determine a target location for the first user and/or the second user to prevent interference from flow effects directed toward another user. A benefit of present embodiments includes the ability to provide experience customization for individuals, even when those individuals may be very near each other (e.g., in the same ride vehicle).

While the flow effect component 110 is depicted as being separate from the ride vehicle 206, in certain embodiments, the flow effect component 110 may be incorporated onto a ride vehicle. For example, the ride vehicle 206 may include one or more flow effect generators 112 on a seat of the ride vehicle, a restraint of the ride vehicle, a wall of the ride vehicle, a floor of the ride vehicle, or any other suitable component of the ride vehicle 206. In some embodiments, one or more flow effect generators 112 incorporated into the ride vehicle 206 (e.g., on a seat, a restraint, a wall, a floor, and so forth) may generate a haptic effect. For example, a flow effect generator 112 incorporated into a restraint of the ride vehicle may provide tactile feedback to a user 118 holding onto the restraint. Further, numerous of the flow effect components 110 may be included to provide different sensations to different riders or portions of a rider's body. For example, in a scene depicting a boat traveling under a bridge that is on fire, heat may be directed to a rider's head while water droplets may be blown across the user's hands resting on a lap bar.

With the foregoing in mind, FIG. 2 illustrates an amusement park attraction 310 incorporating an amusement park attraction effects system 300, such as the fluid flow effects system 100 of FIG. 1, in accordance with an embodiment of the present disclosure. The amusement park attraction 310 includes a ride vehicle 304. The ride vehicle 304 may include spacing and one or more seats for one or more users 118 to sit in the ride vehicle 304 during the duration of the amusement park attraction. In certain embodiments, the ride vehicle 304 may include hydraulics to lift the ride vehicle 304, lower the ride vehicle 304, and/or tilt (e.g., forward, backward, to a side) the ride vehicle 304. The amusement park attraction effects system 300 may include a display 120 depicting an object 302. For example, the object 302 may be an airplane and the display 120 may depict the object 302 passing overhead of the one or more users 118 in the ride vehicle 304. The system 300 may include a location identifier, such as camera 204, and a flow effect component 110 including an array 202 of one or more flow effect generators 112. The camera 204 may detect the presence of one or more users in the amusement park attraction, such as being seated in the ride vehicle 304.

In certain embodiments, the display 120 may be incorporated on the ride vehicle 304. For example, each user 118 may have a corresponding display 120 located on the ride vehicle 304 in front of the user's seat. In some embodiments, the ride vehicle 304 may include a location identifier, such as a GPS sensor and/or gyroscope. The location identifier, such as camera 204, may generate and transmit user location data to a computing device, such as the system controller block 102 in FIG. 1. The display 120 may generate and transmit a signal indicative of a status (e.g., beginning a display sequence) associated with the display 120 to the system controller block 102. For example, the display 120 may depict an image of an airplane passing overhead of one or more users in the ride vehicle 304 and transmit a signal to the system controller block 102. The system controller block 102 of FIG. 1 may receive the user location data and the signal from the display 120 and may determine a set of target locations for one or more users 118 based on the user location data and the status of the display 120. As such, the system controller block 102 may instruct one or more flow effect generators 112 to target one or more target locations for one or more users 118. For example, as the display 120 depicts the airplane passing overhead of one or more users 118, the system controller block 102 may instruct the one or more flow effect generators 112 to generate an air flow effect corresponding to the depicted image on the display 120. The system controller block 102 may dynamically control the one or more flow effect generators 112 based on the signal indicative of the status of the display 120. For example, the system controller block 102 may instruct the one or more flow effect generators 112 to increase the speed of the flow effect as the airplane approaches on the display 120 and/or decrease the speed of the flow effect as the airplane moves further away on the display 120. Additionally or alternatively, the system controller block 102 may instruct the one or more flow effect generators to adjust a target location of the one or more flow effect generators 112. For example, the system controller block 102 may instruct the one or more flow effect generators 112 to target a display facing portion of the user as the airplane approaches on the display 120, an upward facing portion of the user as the airplane passes overhead on the display 120, and a rearward facing portion of the user as the airplane moves further away on the display 120.

Figure 4:
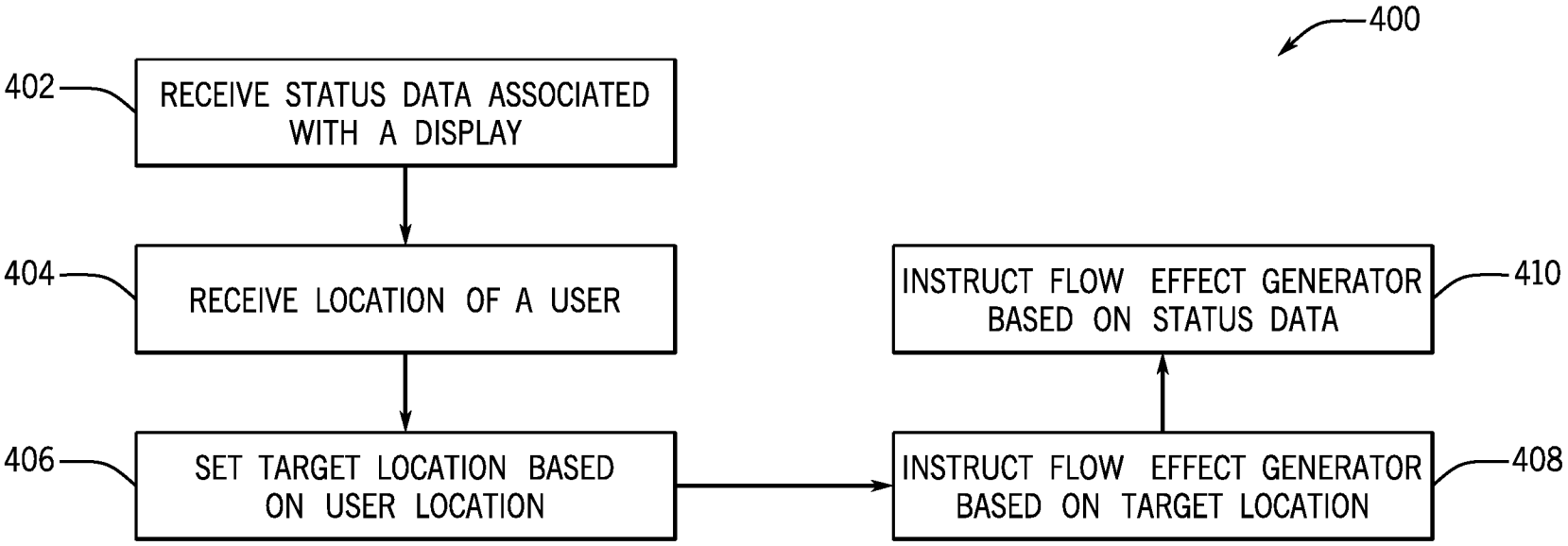
FIG. 4 is a flow diagram of a process for providing amusement park attraction effects, in accordance with an embodiment of the present disclosure.

With the foregoing in mind, FIG. 4 illustrates a flow diagram of a process 400 for providing amusement park attraction effects using an amusement park attraction effects system, such as the system 100 in FIG. 1, in accordance with an embodiment of the present disclosure. While the process 400 is described as being performed by the automation controller 116, it should be understood that the process 400 may be performed by any suitable device, such as the processor 104, that may control and/or communicate with components of an amusement park attraction effects system. Furthermore, while the process 400 is described using steps in a specific sequence, it should be understood that the present disclosure contemplates that the described steps may be performed in different sequences than the sequence illustrated, and certain described steps may be skipped or not performed altogether. In some embodiments, the process 400 may be implemented by executing instructions stored in a tangible, non-transitory, computer-readable medium, such as the memory 106, using any suitable processing circuitry, such as the processor 104.

In the process 400, a display, such as display 120 in FIG. 1, may generate and communicate a signal indicative of a status associated with the display. A display monitor, such as display monitor 108 in FIG. 1, may receive the signal and may generate status data indicative of the status in response to receiving the signal. The status data may be received, for example, at the automation controller 116 (step 402). Additionally or alternatively, the automation controller 116 may receive the signal and may generate status data indicative of the status in response to receiving the signal from the display 120.

A location identifier, such as location identifier 122 in FIG. 1, may generate a set of user location data for one or more users and may determine a location(s) of the one or more users based on the set of user location data. In certain embodiments, the location identifier may determine a body orientation of one or more users, may determine a location of a body part of one or more users, may determine an area of exposed skin on one or more users, or any combination thereof. The location identifier may transmit the set of user location data and/or the location(s) of the one or more users and the automation controller 116 may receive the set of user location data and/or the location(s) of the one or more users (step 404).

At step 406, the automation controller 116 may determine a set of target locations based on the set of user location data and/or the location(s) of the one or more users. For example, exposed skin of the user may be targeted with a chilled airflow to create an impression of being in a frozen environment. Additionally or alternatively, the automation controller 116 may determine a set of target locations based on the status data associated with the display 120. The automation controller 116 may dynamically update the set of target locations in response to receiving additional user location data and/or receiving additional status data.

At step 408, the automation controller 116 may instruct one or more flow effect generators, such as flow effect generator 112, to direct a fluid flow effect based on the set of determined target locations. Additionally or alternatively, the automation controller 116 may instruct one or more flow effect generators to direct a fluid flow effect based on the status data.

At step 410, the automation controller 116 may instruct one or more flow effect generators to control the fluid flow effect based on the status data. For example, the automation controller may instruction one or more flow effect generators to alter a speed, a water composition, a temperature, a size, or any other suitable aspect of the fluid flow effect.

While only certain features of the present disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement park attraction effects system, comprising:

a dynamic display configured for viewing by a user traveling through an attraction;

a display monitor configured to monitor changes to the dynamic display and provide status data indicative of a status of the dynamic display;

a location identification system configured to determine a location of the user;

a thrust-vectoring flow effect generator configured to generate and direct a fluid flow toward any particular target location of a range of target locations within the attraction; and an automation controller communicatively coupled to the display monitor, the location identification system, and the thrust-vectoring flow effect generator, wherein the automation controller is configured to:

receive the status data provided by the display monitor;

receive the location of the user provided by the location identification system;

set a target location based on the location of the user, wherein the target location is within the range of target locations;

instruct the thrust-vectoring flow effect generator to direct the fluid flow based on the target location; and instruct the thrust-vectoring flow effect generator to control the fluid flow based on the status data.

2. The system of claim 1, wherein the thrust-vectoring flow effect generator is configured to adjust a temperature of the fluid flow or a shape of the fluid flow in response to instructions from the automation controller based on the status data.

3. The system of claim 1, wherein the thrust-vectoring flow effect generator is configured to adjust a speed and direction of the fluid flow by modifying a configuration of a nozzle of the thrust-vectoring flow effect generator in response to instructions from the automation controller based on the status data.

4. The system of claim 1, wherein the location identification system is configured to determine the location as including a location of a portion of the user and the automation controller is configured to adjust the target location based on the location of the portion of the user.

5. The system of claim 4, wherein the location of the portion of the user corresponds to an area of exposed skin or a body part of the user.

6. The system of claim 1, wherein the thrust-vectoring flow effect generator is configured to generate one or more pulses of compressed air as the fluid flow.

7. The system of claim 1, wherein the location identification system comprises a camera configured to capture an image of a user, and wherein the location identification system is configured to determine an orientation of the user based on the image.

8. The system of claim 7, wherein the automation controller is configured to instruct the thrust-vectoring flow effect generator to direct the fluid flow based on the orientation of the user.

9. The system of claim 1, wherein the thrust-vectoring flow effect generator is configured to control the fluid flow by including one or more of fog, smoke, or water droplets.

10. The system of claim 1, comprising a portable device configured to be carried by the user and configured to generate a signal, wherein the location identification system comprises a sensor configured to sense the location of the user based on the signal.

11. An amusement park attraction effects system, comprising:

a dynamic display configured for viewing by a plurality of users;

a display monitor configured to monitor changes to the dynamic display and provide status data indicative of a status of the dynamic display;

a location identification system configured to determine a plurality of locations of the plurality of users;

an array of thrust-vectoring flow effect generators comprising a first thrust-vectoring flow effect generator and a second thrust-vectoring flow effect generator, the first thrust-vectoring flow effect generator configured to generate and direct a first fluid flow toward a first target location of a range of target locations and the second thrust-vectoring flow effect generator configured to generate and direct a second fluid flow toward a second target location of the range of target locations; and an automation controller communicatively coupled to the display monitor, the location identification system, and the array, wherein the automation controller is configured to:

receive the status data provided by the display monitor;

receive the plurality of locations of the plurality of users provided by the location identification system;

set the first target location and the second target location based on the plurality of locations of the plurality of users; and instruct the first thrust-vectoring flow effect generator to direct the first fluid flow based on the first target location; and instruct the second thrust-vectoring flow effect generator to direct the second fluid flow based on the second target location.

12. The system of claim 11, wherein the automation controller is configured to instruct the first thrust-vectoring flow effect generator to direct the first fluid flow based on the status data.

13. The system of claim 11, wherein the automation controller is configured to instruct the first thrust-vectoring flow effect generator to control the first fluid flow based on the first target location.

14. The system of claim 11, wherein the first target location and the second target location are the same.

15. The system of claim 14, wherein the first thrust-vectoring flow effect generator comprises a nozzle configured to direct the first fluid flow via asymmetric or symmetric modification to a shape of the nozzle.

16. An amusement park attraction effects system, comprising:

a head-mounted virtual reality (VR) device comprising an electronic display configured to display an image to a user of the head-mounted VR device;

a user sensing system of the head-mounted VR device, the user sensing system configured to detect a location and orientation of the user and output data indicative of the location and orientation;

an directed airflow generator configured to generate an air effect and direct the air effect to a target location; and an automation controller communicatively coupled to the user sensing system and the directed airflow generator, wherein the automation controller is configured to:

receive the data output by the user sensing system;

determine, based on the location and the orientation indicated by the data, the target location for directing the air effect; and control the directed airflow generator to direct the air effect towards the target location.

17. The system of claim 16, wherein the automation controller is configured to control the directed airflow generator to coordinate a timing of providing the airflow with a VR presentation being provided by the head-mounted VR device.

18. The system of claim 16, wherein the automation controller is configured to control a heating element or a cooling element to change a temperature of the air effect based on a VR presentation being provided by the head-mounted VR device.

19. The system of claim 16, comprising a plurality of directed airflow generators each configured to direct a corresponding airflow to a respective target location within a respective range of locations.

20. The system of claim 16, wherein:

the directed airflow generator comprises a matrix of smaller directed airflow generators, each of the smaller directed airflow generators configured to produce a pulse of compressed air as the air effect; and the automation controller is configured to change a pattern of the air effect.

* * * * *